US005682130A

United States Patent [19]

Styrna et al.

[11] Patent Number: 5,682,130

[45] Date of Patent: Oct. 28, 1997

[54] CIRCUIT PROTECTION DEVICE WITH FEMALE TERMINALS AND PTC ELEMENT

[76] Inventors: Michael Styrna, 221 Saratoga Ct., Gurnee, Ill. 60031; Andrew Tomlinson, 1126 Guinda St., Palo Alto, Calif. 94301

[21] Appl. No.: 474,331

[22] Filed: Jun. 7, 1995

Related U.S. Application Data

[63] Continuation-in-part of Ser. No. 408,473, Mar. 22, 1995.

[51] Int. Cl.[6] ..... H01H 85/02; H01H 85/52; H01H 85/62; H01C 7/10

[52] U.S. Cl. ..... 337/190; 337/197; 337/198; 337/216; 338/22 R

[58] Field of Search ..... 338/22 R; 337/186, 337/190, 197, 198, 216

[56] References Cited

U.S. PATENT DOCUMENTS

| | | | |
|---|---|---|---|
| 4,331,861 | 5/1982 | Meixner | 219/553 |
| 4,570,147 | 2/1986 | Ebi | 337/166 |
| 4,672,352 | 6/1987 | Takano | 337/264 |
| 4,698,614 | 10/1987 | Welch et al. | 338/22 R |
| 4,751,490 | 6/1988 | Hatagishi | 337/295 |
| 4,780,698 | 10/1988 | Tomkinson | 337/113 |
| 4,869,972 | 9/1989 | Hatagishi | 428/647 |
| 4,871,990 | 10/1989 | Ikeda et al. | 337/238 |
| 4,894,637 | 1/1990 | Yamada | 338/22 R |
| 4,958,426 | 9/1990 | Endo et al. | 29/623 |
| 4,967,176 | 10/1990 | Horsma et al. | 338/22 R |
| 5,142,265 | 8/1992 | Motoyoshi et al. | 338/22 R |
| 5,153,555 | 10/1992 | Enomoto et al. | 338/22 R |
| 5,233,326 | 8/1993 | Motoyoshi | 338/22 R |
| 5,262,619 | 11/1993 | Karner | 392/485 |
| 5,294,906 | 3/1994 | Totsuka et al. | 337/260 |
| 5,394,134 | 2/1995 | Kurz | 337/398 |

FOREIGN PATENT DOCUMENTS

| | | |
|---|---|---|
| 0 242 902 A2 | 10/1987 | European Pat. Off. . |
| 0 259 179 A2 | 3/1988 | European Pat. Off. . |

*Primary Examiner*—Leo P. Picard
*Assistant Examiner*—Stephen T. Ryan
*Attorney, Agent, or Firm*—Wallenstein & Wagner, Ltd.

[57] ABSTRACT

The invention is a circuit protection device comprising a first and a second female terminal. The device further comprises a first fuse clip in electrical contact with the first fuse terminal and a second fuse clip in electrical contact with the second fuse terminal. A positive temperature coefficient element, preferably planar, is positioned between and makes electrical contact with both the first fuse clip and the second fuse clip. In a first embodiment, at least one of the first and second fuse clips is spring-loaded, i.e., has an inherent resiliency. In this same embodiment, portions of the first and second fuse clips overlap, and the positive temperature coefficient element is secured between the overlapping portions of the first and second fuse clips. In the second of the two preferred embodiments, the first fuse clip, the second fuse clip, and the positive temperature coefficient element are generally coplanar.

12 Claims, 2 Drawing Sheets

CIRCUIT PROTECTION DEVICE WITH FEMALE TERMINALS AND PTC ELEMENT

RELATED APPLICATIONS

This application is a continuation-in-part of U.S. application Ser. No. 08/408,473, filed on Mar. 22, 1995. This application is also related to a copending application Ser. No. 08/480,124 which is entitled "RESETTABLE AUTOMOTIVE CIRCUIT PROTECTION DEVICE."

TECHNICAL FIELD

The invention is a circuit protection device. Particularly, the invention is a circuit protection device which includes female terminals and one or more positive temperature coefficient (PTC) elements.

BACKGROUND OF THE INVENTION

Fuses that are suited for use in automobiles and other circuit protection purposes may be found in both male- and female-type configurations. Many such fuses are two-piece assemblies.

One common configuration includes a box-like housing and an all metal male or female one-piece fuse element secured within that box-like housing. Some such prior female fuse assemblies have a metal female fuse element with a pair of spaced-apart female terminals which are accessible from one end of the housing. The female terminals are closely proximate to the housing walls.

An unsupported fuse link is typically suspended between the extensions of the female terminals. The fuse link is closely spaced from the housing side walls. A low fusing point metal is typically attached to the fuse link.

The housing has slot-like openings at one of its ends, and the female terminals are accessible from these slot-like openings. Particularly, male blade-type terminals can be inserted through these slot-like openings to access the female terminals. These male blade-type conductors typically extend from a mounting panel or fuse block. Typical one-piece female fuse elements and the methods of making them are described in U.S. Pat. Nos. 4,344,060, 4,570,147, 4,751,490 and 4,958,426.

Automobile and other female fuse assemblies also have included an all metal female three-piece fuse element in place of a one-piece fuse element. As in the previously mentioned female fuses, the metal female fuse element has a pair of spaced-apart female terminals which are accessible from one end of the housing. The female terminals can be created from typical male terminals by adding female sockets to the male terminals, however, rather than forming the complete female fuse element from one piece. This structure and method of making such a fuse is described in U.S. Pat. Nos. 4,672,352 and 4,869,972.

There are several constraints which exist when working with a one-piece female fuse construction. For example, the stiffness or resilience (spring qualities), as well as the conductivity, of the fuse element material become important factors in determining the materials to be used. It is clear that the conductivity of the material is important, because of the principle that unnecessary resistance will increase the voltage drop of the fuse, thus reducing the amount of current flowing through the fuse. The resilience of the material is also important because the female engagement portion of the female fuse element must be durable and spring-like in order to continuously grip the male terminals on the terminal block in a snug manner. The resiliency is important in view of gravitational forces exerted on the fuse element when current heats up the fuse element, as described in U.S. Pat. No. 4,635,023.

When determining an appropriate construction for a three-piece fuse, the designer can choose materials for the fuse element which are different from the materials of the female sockets. Specifically, the designer may choose a material for the fuse element which will allow for suitable conductivity, while at the same time the designer can choose a different material for the female sockets which will provide ample resilience to effect a snug fit between the fuse element, sockets, and male terminals inserted in the female socket. A snug fit will keep the resistance, and thus the current loss, low between the terminals of the fuse element and male terminals connected or linked thereto by the sockets.

A snug fit only exists if there is practically no movement between the fuse element, sockets, and male terminals inserted in the sockets. These elements should also remain still, relative to their housing, to prevent the snug fit from being broken by any movement between these elements. If the fit between the fuse element, sockets and male terminals does not remain snug over time, the resistance will increase and become unsatisfactory for prolonged commercial use.

Although U.S. Pat. No. 4,869,972 to Hatagishi discloses a three-piece female fuse configuration, this patent does not disclose a configuration that lends itself to a prolonged snug fit. The female sockets from this patent are disclosed as being used for testing. It is believed, however, that if this configuration was placed in a commercial environment (i.e., onto a male fuse block within an automobile), small vibrations in the commercial environment would cause the fit between the fuse element, sockets and male terminals to move about and loosen. Without a snug fit, movement between these elements would cause a higher resistance within the fit, causing a loss of current as well as unwanted heating of the fuse connections near the fuse block.

U.S. Pat. No. 4,672,352 also discloses a three-piece fuse assembly which includes a fuse element, tab insertion sockets, and a housing to house the element and sockets. The focus of this patent is that the fuse element can be replaced without replacing the sockets or housing. Thus, construction of the housing allows for the fuse element to be removed without removing the sockets. This construction also appears to fail to provide firm fit of the sockets or fuse element within the housing, unless a male terminal is inserted in the sockets to force these elements outward from the male terminal. In addition, the fuse element is not secured to the socket in any way. The sockets are secured to the housing in a manner independent to the securement of the fuse element to the housing. If the fuse terminal moves within the housing, not only will the fuse element move in relation to the housing, but it will also move in relation to the sockets. Movement of the fuse element would also likely take place relative to the male terminal.

The present invention is provided to solve these and other problems, while also providing for an improved, resettable fuse that includes a polymeric PTC material in lieu of a conventional, metallic fusible link.

Other generally relevant U.S. patents include U.S. Pat. Nos. 4,331,861, issued to Meixner on May 25, 1982; 4,698,614, issued to Welch et al. on Oct. 6, 1987; 5,142,265, issued to Motoyoshi et al. on Aug. 25, 1992; 5,153,555, issued to Enomoto et al. on Oct. 6, 1992; and 5,233,326, issued to Motoyoshi on Aug. 3, 1993.

SUMMARY OF THE INVENTION

The invention is a circuit protection device comprising a first and a second female terminal. The device further comprises a first fuse clip in electrical contact with the first fuse terminal and a second fuse clip in electrical contact with the second fuse terminal. A positive temperature coefficient element is positioned between and makes electrical contact with both the first fuse clip and the second fuse clip.

Preferably, the positive temperature coefficient element is planar, and may be made of polyethylene and carbon black.

There are two preferred embodiments of the invention. In the first embodiment, at least one of the first and second fuse clips is spring-loaded. In this same embodiment, portions of the first fuse clip and the second fuse clip overlap. In such an embodiment, the positive temperature coefficient element is secured between the overlapping portions of the first fuse clip and said second fuse clip.

In the second of the two preferred embodiments, the first fuse clip and said second fuse clip are generally coplanar. In such an embodiment, the first fuse clip and second fuse clip are also generally coplanar with the positive temperature coefficient element.

DETAILED DESCRIPTION OF THE PREFERRED EMBODIMENT

The invention is a circuit protection device, comprising a first and a second female terminal. The device further comprises a first fuse clip in electrical contact with the first fuse terminal and a second fuse clip in electrical contact with the second fuse terminal. A positive temperature coefficient element is positioned between and makes electrical contact with both the first fuse clip and the second fuse clip.

Preferably, the positive temperature coefficient element is planar, and may be made of polyethylene and carbon black.

Figure 1:
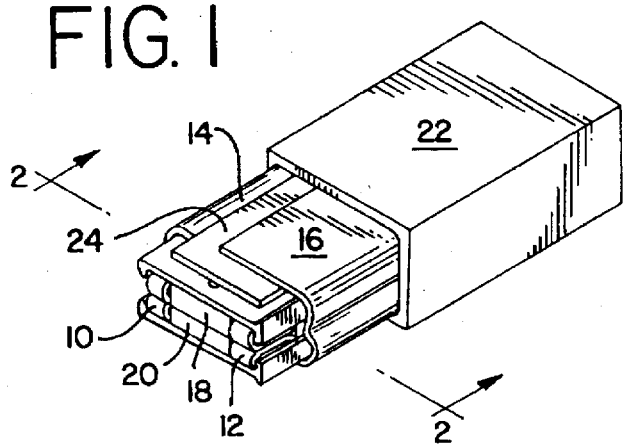
FIG. 1 is a perspective view of a first embodiment in accordance with the invention, but with the fusible assembly partially removed from its housing so that the details of that assembly may be seen.
Figure 2:
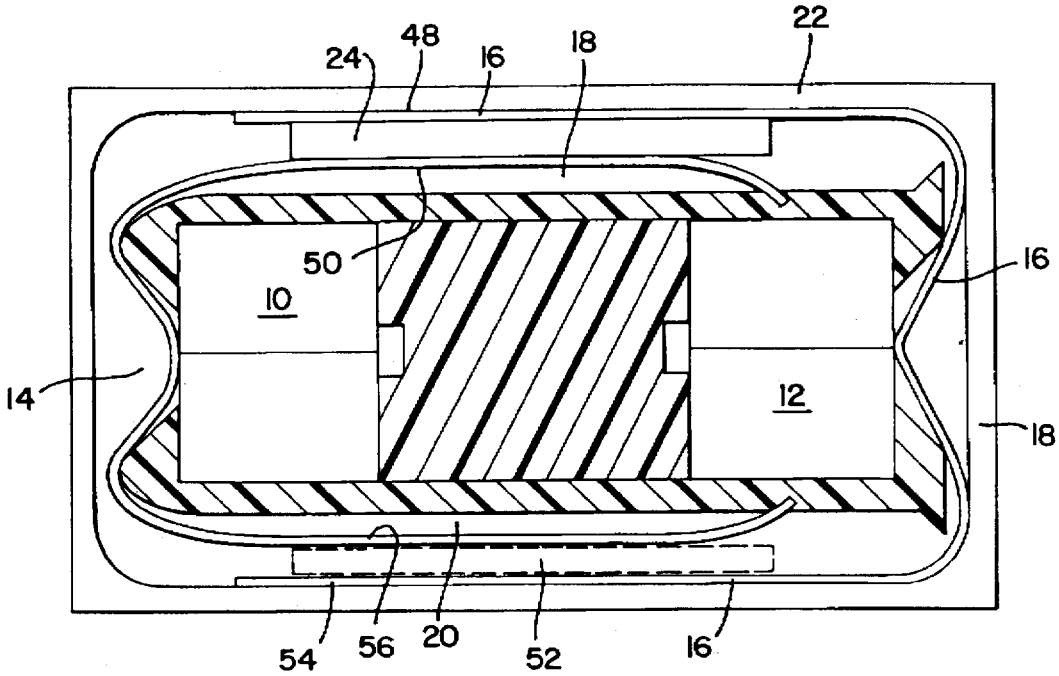
FIG. 2 is a sectional view, taken along lines 2—2 of FIG. 1, of the first embodiment in accordance with the invention.

Embodiment of FIGS. 1 and 2

There are two preferred embodiments of the invention. The first embodiment is shown in FIGS. 1 and 2. As may be seen in FIG. 1, the circuit protection device comprises a first 10 and a second 12 female terminal. The female terminals 10 and 12 are made of a conductive metal, preferably tin-plated copper or copper alloy.

The device further comprises a first fuse clip 14 with an electrical contact that may be punched and formed as a part of the first fuse terminal 10. Alternatively, the first fuse clip 14 may be separately formed from the first fuse terminal 10, and the two may be mechanically and electrically secured by soldering. Similarly, a second fuse clip 16 is also in electrical contact with the second fuse terminal 12. Again, the two elements are preferably punched and formed as one unit, but may also be made as two separate units, and then soldered together. The relationship of the first fuse clip 14 to the first fuse terminal 10 and of the second fuse clip 16 to the second fuse terminal 12 may best be seen in FIG. 2. If made of a separate structure from the terminals 10 and 12, then the first and second fuse clips 14 and 16 are made from a conductive metal such as copper, or any other suitable conductive material. For reasons that will be explained, the conductive metal should have spring-like characteristics.

As may also be seen in FIG. 2, the first and second fuse clips 14 and 16 circumscribe a pair of planar insulating elements 18 and 20. The insulating elements 18 and 20 may be made of nylon, a polycarbonate, or any other suitable insulator. The insulating elements 18 and 20 are preferably molded of one piece, but can also be made of two pieces and then secured together by screws or other suitable fastening means. First fuse clip 14 fits closely to the supporting structure formed by planar insulating elements 18 and 20, while second fuse clip 16 is spaced somewhat more distantly from that structure. Because of the "springiness" of the first and second fuse clips 14 and 16, they may be moved resiliently towards and away from each other. For example, the second fuse clip 16 of FIG. 2 may be manually moved towards a point where it contacts the first fuse clip 14. Upon release of the second fuse clip 16, the resiliency of the second fuse clip 16 would cause it to move away from the first fuse clip 14 into a position, as shown in FIG. 2, where there is no engagement between the first and second fuse clips 14 and 16.

In order to keep pressure on the fuse clip 16 so that it is held closely to fuse clip 14, a housing 22 is provided. This housing 22 may made of the same insulating material as the planar insulating elements 18 and 20. To more clearly show the components of the novel fuse assembly, FIG. 1 shows the main portion of the fuse assembly in a position that is somewhat withdrawn from its housing 22. During normal operation, the working or conductive portion of the fuse assembly, including the terminals and fuse clips, is inserted into and is entirely enclosed by the housing 22.

The structure shown in the cross-section of FIG. 2 and described to this point does not complete a circuit through the device. Rather, as may be seen in FIGS. 1 and 2, the circuit is completed by the imposition of a positive temperature coefficient (PTC) element 24 between the first and second fuse clips 14 and 16.

When the PTC element 24 is not positioned between the first and second fuse clips 14 and 16, the distance between the first and second fuse clips 14 and 16 is typically less than the thickness of the PTC element 24. Thus, when the PTC element 24 is placed between the first and second fuse clips 14 and 16, the second fuse clip 16 moves away from the first fuse clip 14 to accommodate the thickness of that PTC element 24. The "springiness" of the second fuse clip 16 results, however, in a biasing of that second fuse clip 16 towards first fuse clip 14, securing by pressure the PTC element 24 between the first and second fuse clips 14 and 16.

Thus, when the main portion of the fuse assembly, including the insulating elements 18 and 20 and the first and second fuse clips 14 and 16, is outside of the housing 22, the "springiness" of the second fuse clip 16 retains the PTC element 24 firmly between the first and second fuse clips 14 and 16. When the structure is positioned inside the housing 22, the compressive force of the housing on the structure and on the second fuse clip 16 further aids in firmly retaining the PTC element 24 between the first and second fuse clips 14 and 16.

As indicated above, the positive temperature coefficient element 24 is positioned between and makes electrical contact with both the first and second fuse clips 14 and 16. As a result, current may pass between the first and second terminals 10 and 12.

Particularly, in FIG. 2, the PTC element 24 is shown positioned between the upper portion 50 of the first fuse clip 14 and the upper portion 48 of the second fuse clip 16. Current passing through the device of the invention passes from the first female terminal 10 to the upper portion 50 of the first fuse clip 14 to the PTC element 24 to the upper portion 48 of the second fuse clip 16, and out of the device through the second female terminal 12.

Preferably, the positive temperature coefficient element 24 is planar. The positive temperature coefficient element 24 may be made of polyethylene and carbon black. The preferred forms of the present invention utilize plate-like PTC elements. Such plate-like PTC elements may be made by the following process. A quantity of high density polyethylene (HDPE) (manufactured by Quantum under the trade name Petrothene) and carbon black (manufactured by Cabot under the trade name BP 160-Beads) is dried by placing it in an oven at 100° C. overnight. A PTC polymer composition comprising 65% (by volume) polyethylene and 35% (by volume) carbon black is then prepared as follows.

The polyethylene is placed in a C. W. Brabender Plasti-Corder PL 2000 equipped with a Mixer-Measuring Head and fluxed at 200° C. for approximately five minutes at 5 rpm. At this point, the polyethylene is in a molten form. The carbon black is then slowly dispersed into the molten polyethylene over a five minute period at 200° C. and 5 rpm. The speed of the Brabender mixer is then increased to 80 rpm, and the molten HDPE and carbon black are thoroughly mixed at 200° C. for five minutes. The energy input, due to the mixing, causes the temperature of the composition to increase to 240° C.

After allowing the composition to cool, the composition is then placed into a C. W. Brabender Granu-Grinder where it is ground into small chips. The chips are then fed into the C. W. Brabender Plasti-Corder PL 2000 equipped with an Extruder Measuring Head. The extruder is fitted with a die having an opening of 0.002 inches, and the belt speed of the extruder is set at 2. The temperature of the extruder is set at 200° C., and the screw speed of the extruder is measured at 50 rpm. The chips are extruded into a sheet approximately 2 inches wide by 8 feet long. This sheet is then cut into a number of 2 inch×2 inch PTC elements.

Nickel foil electrodes are then brought into contact with the top and bottom surfaces of the 2 inch×2 inch PTC element. The sandwich structure, i.e., the polymer PTC element interposed between the nickel foil electrodes, is then placed in a hot press for approximately three to five minutes at 400 p.s.i. and 230° C. The laminated sheet is then removed from the press and allowed to cool without further pressure. The laminated sheet is then sheared into a plurality of PTC devices.

The resulting planar PTC elements 24 have an electrical resistance at 25° C. of approximately 0.1 ohm.

Also shown in FIG. 2, in dashed lines, is a planar insulator 52. This planar insulator 52 may be made from any insulating material, including nylon or polycarbonate. The purpose of the planar insulator 52 is to prevent contact between the lower portion 54 of second fuse clip 16 and the lower portion 56 of first fuse clip 14. The prevention of such contact ensures that all current will pass through the PTC element 24, and that no current will pass through the lower portions 56 and 54 of first and second fuse clips 14 and 16. If such contact occurred, the device would prove ineffective, as all current would pass through the short circuit path created by the contact of the lower portions 56 and 54 of first and second fuse clips 14 and 16.

Another PTC element may be directly substituted for the planar insulator 52 shown in the dotted lines of FIG. 2. If another PTC element were, in fact, substituted for the insulator 52 shown in FIG. 2, then the current flowing through the device of FIG. 2 would be divided, and would pass through each of the two PTC elements now in the circuit. As a result, the placement of another PTC element in the device, in lieu of insulator 52, would result in an electrical device having parallel PTC elements, and would further result in a device having a higher current rating than a device which includes only one PTC element 24.

As may be understood from the embodiment of FIGS. 1 and 2, portions of the first and second fuse clips 14 and 16 overlap. As indicated above, in such an embodiment, the positive temperature coefficient element 24 is secured between the overlapping portions of the first and second fuse clips 14 and 16.

Figure 3:
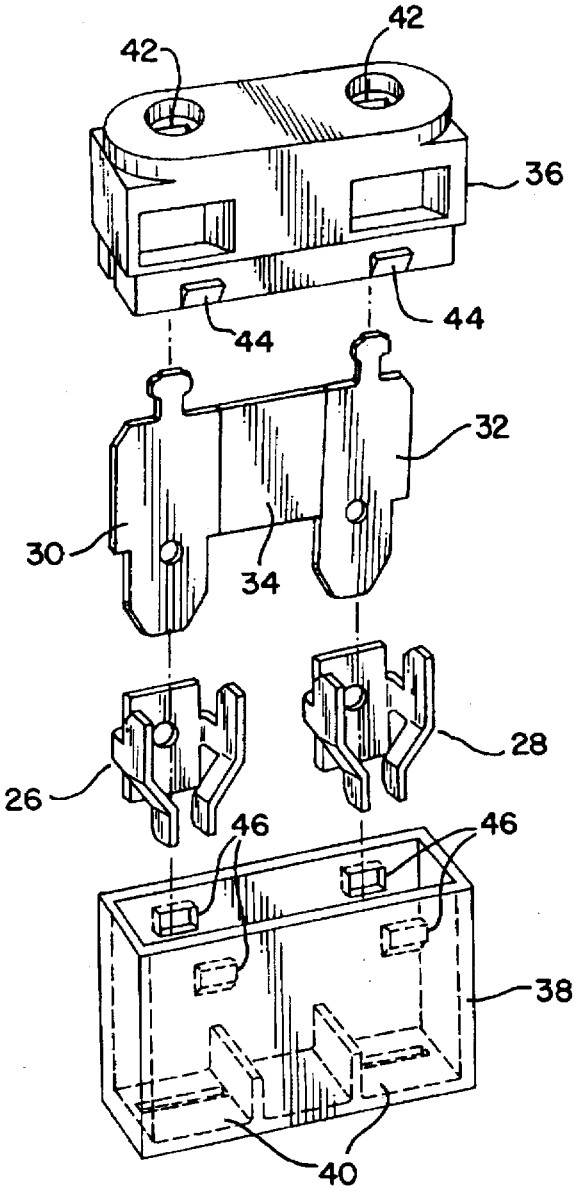
FIG. 3 is a perspective, exploded view of a second embodiment in accordance with the invention.
Figure 4:
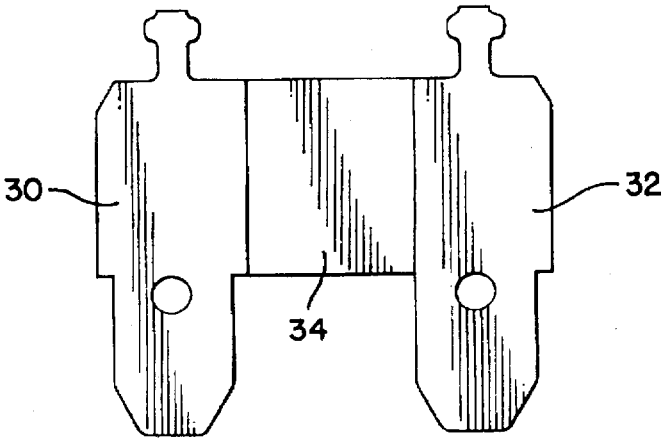
FIG. 4 is a side elevational view of the fuse clip assembly of the device of FIG. 3, showing the positive temperature coefficient element secured between the first and second fuse clips, and positioned in a common plane with the first and second fuse clips.

Embodiment of FIGS. 3 and 4

The second of the two embodiments is shown in FIGS. 3 and 4. This embodiment is also a circuit protection device comprising first and second female terminals 26 and 28. The device further comprises a first fuse clip 30 in electrical contact with the first fuse terminal 26 and a second fuse clip 32 in electrical contact with the second fuse terminal 28. A positive temperature coefficient element 34 is positioned between and makes electrical contact with both the first and second fuse clips 30 and 32.

Again, it is preferable that the positive temperature coefficient element 34 is planar, and be made of polyethylene and carbon black. The PTC element 34 may be made in the same manner described above for the PTC element 24.

In this second of the two preferred embodiments, the first and second fuse clips 30 and 32 are generally coplanar. In such an embodiment, the first and second fuse clips 30 and 32 are also generally coplanar with the positive temperature coefficient element 34. That PTC element 34 may be soldered between the first and second fuse clips 30 and 32.

A two-piece housing comprising elements 36 and 38 house the components of the fuse. Openings 40 are provided at the base of housing element 38 to provide access to the female terminals 26 and 28.

Housing element 36 includes testing holes 42, permitting access to the fuse clips 30 and 32. Four tabs 44 in element 36 mate in a snapping fashion with four corresponding holes 46 in element 38, so that the two elements 36 and 38 are snugly retained to each other.

What we claim is:

1. A circuit protection device, comprising:

a first and a second female terminal interposed between first and second insulating elements;

a first fuse clip circumscribing the first and second insulating elements and making electrical contact with the first female terminal;

a second fuse clip circumscribing the first and second insulating elements and making electrical contact with the second female terminal; and, a positive temperature coefficient element positioned between and making electrical contact with the first and second fuse clips.

2. The circuit protection device of claim 1, wherein the positive temperature coefficient element is comprised of a polymer having a conductive filler dispersed therein.

3. The circuit protection device of claim 1, wherein the first and second fuse clips are formed from a resilient material and arranged such that one fuse clip is biased towards the other fuse clip.

4. The circuit protection device of claim 3, wherein the resilient material comprises copper.

5. The circuit protection device of claim 3, wherein the resilient material comprises tin-plated copper.

6. The circuit protection device of claim 3, wherein portions of the first and second fuse clips overlap.

7. The circuit protection device of claim 5, wherein the positive temperature coefficient element is secured between the overlapping portions of the first and second fuse clips.

8. The circuit protection device of claim 1, wherein the first female terminal and the first fuse clip are formed from the same sheet of material.

9. The circuit protection device of claim 1, wherein the first and second fuse clips each have an upper portion and a lower portion, the upper portions of the first and second fuse clips overlap and secure therebetween the positive temperature coefficient element, and the lower portions of the first and second fuse clips overlap and secure therebetween a second positive temperature coefficient element.

10. The circuit protection device of claim 1 further including a housing which restricts the resiliency of the first and second fuse clips.

11. A circuit protection device, comprising:

a first and a second female terminal interposed between first and second insulating elements;

a first fuse clip circumscribing the first and second insulating elements and making electrical contact with the first female terminal;

a second fuse clip circumscribing the first and second insulating elements and making electrical contact with the second female terminal, a portion of the second fuse clip overlapping a portion of the first fuse clip;

a positive temperature coefficient element positioned between the overlapping portions of the first and second fuse clips; and a housing formed from an electrically insulating material, the housing applying a pressure to the second fuse clip thus retaining the positive temperature coefficient element in electrical contact with the overlapping portions of the first and second fuse clips.

12. A circuit protection device, comprising:

a first and a second female terminal;

a first fuse clip in electrical contact with the first female terminal;

a second fuse clip in electrical contact with the second female terminal, portions of the first and second fuse clips overlapping one another; and, a positive temperature coefficient element having electrodes affixed to top and bottom surfaces, the element positioned between and in direct contact with the overlapping portions of the first and second fuse clips, the surface area of the electrodes in direct contact with the fuse clips being greater than the surface area of the electrodes not in direct contact with the fuse clips.

* * * * *

UNITED STATES PATENT AND TRADEMARK OFFICE

CERTIFICATE OF CORRECTION

PATENT NO. : 5,682,130

DATED : October 28, 1997

INVENTOR(S) : MICHAEL STYRNA and ANDREW TOMLINSON

It is certified that error appears in the above-identified patent and that said Letters Patent is hereby corrected as shown below:

Column 5, Line 45, "inchX2" should be --inch X 2--.

Column 5, Line 47, "inchX2" should be --inch X 2--.

Signed and Sealed this

Fourteenth Day of April, 1998

Bruce Lehman

*Attest:*

BRUCE LEHMAN

*Attesting Officer*

*Commissioner of Patents and Trademarks*